United States Patent [19]

Magni

[11] 4,306,814

[45] Dec. 22, 1981

[54] APPARATUS FOR MIXING CONCRETE

[76] Inventor: Vittorio Magni, Via Aria Nuova 1, Ferrara, Italy

[21] Appl. No.: 51,654

[22] Filed: Jun. 25, 1979

[51] Int. Cl.[3] ..... B28C 5/06; B28C 5/46

[52] U.S. Cl. ..... 366/10; 366/25

[58] Field of Search ..... 366/10, 11, 12, 13, 366/22, 23, 24, 25, 101, 144, 145, 147

[56] References Cited

U.S. PATENT DOCUMENTS

| | | | |
|---|---|---|---|
| 1,578,021 | 3/1926 | Elze | 366/25 |
| 1,875,516 | 9/1932 | Stary | 366/24 |
| 3,674,242 | 7/1972 | Stewart | 366/25 |
| 4,089,508 | 5/1978 | Anderson | 366/25 |

*Primary Examiner*—Edward J. McCarthy

*Attorney, Agent, or Firm*—Guido Modiano; Albert Josif

[57] ABSTRACT

A concrete mixing apparatus comprises a mixing vessel at the bottom of which a plurality of heated steam injectors are arranged, the opening and closing whereof are controlled by valves slaved to actuating means.

6 Claims, 3 Drawing Figures

Fig. 1
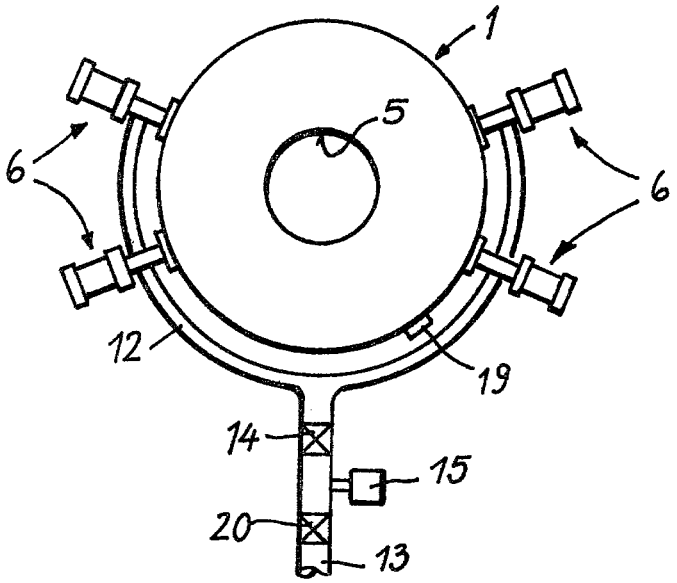
Fig. 2
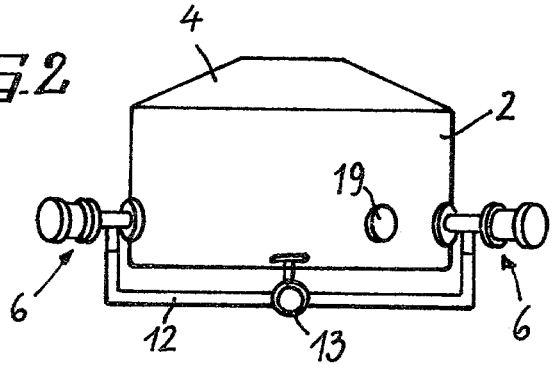
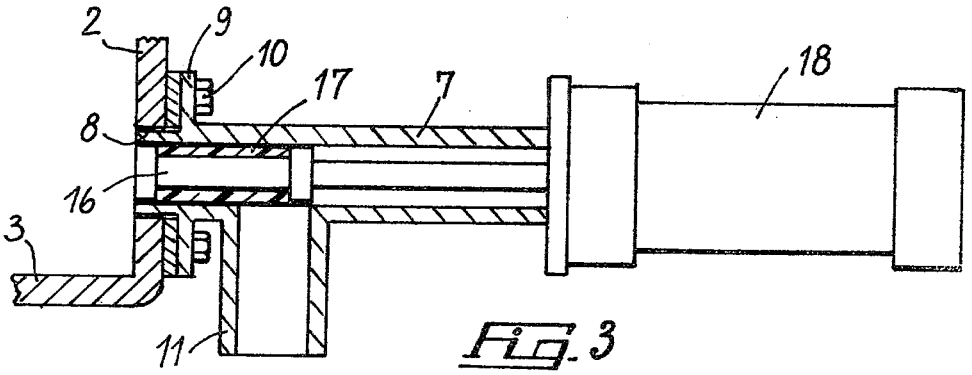
Fig. 3

APPARATUS FOR MIXING CONCRETE

BACKGROUND OF THE INVENTION

This invention relates to an apparatus for mixing concrete.

Known is the great importance of concrete members, whether prefabricated or cast directly at the job site, and utilized for erecting civil and industrial constructions, such as roads, bridges, poles, and so forth.

In the prefabricated and in situ casting concrete techniques, it is of paramount importance to minimize the setting and hardening time, in order for the forms or molds wherein the concrete is cast to be readily available for re-use.

Various techniques have long been known which, to reduce the concrete setting and hardening time, provide for a concrete heating step subsequent to the casting of the concrete into the forms or molds. However, the equipment used is rather complicated and requires frequent modifications to fit the various forms or molds.

SUMMARY OF THE INVENTION

Therefore the main object of the invention is to provide an apparatus whereby the concrete is heated prior to casting it into the forms or molds, thus avoiding the problems encountered when heat is supplied to the concrete after it has been cast into the forms.

According to one aspect of the present invention, there is provided an apparatus for mixing concrete characterized in that it comprises a concrete mixing vessel, a plurality of injectors communicating with the vessel inside and arranged at the bottom thereof, means for connecting said injectors to a steam source, valve means controlling the opening and closing of said injectors, and actuating means controlling the opening and closing of said valve means.

BRIEF DESCRIPTION OF THE DRAWING

Further features of the invention will be more clearly understood from the following description of an embodiment thereof, with reference to the accompanying drawing, where:

FIG. 1 is a plan view of the apparatus;

FIG. 2 is an elevational view thereof; and

FIG. 3 is a detail view of one injector and related actuator.

DESCRIPTION OF A PREFERRED EMBODIMENT

The apparatus illustrated in the drawing comprises a mixer including a vessel 1 having a cylindrical wall 2, a bottom 3, and a cover 4 of truncated cone shape wherein a mouth or aperture 5 is provided centrally for the introduction of the components to be mixed therethrough, which mouth also serves as the discharge outlet for the concrete mix.

The vessel is supported in a known manner such as to allow the concrete to be discharged, and internally thereto suitable stirrers are arranged which are not shown because they are quite conventional.

At the vessel bottom, there are mounted radially arranged injectors, generally indicated at 6, one of which injectors is shown more in detail in FIG. 3.

Each injector comprises a sleeve 7 extending, with a portion thereof, through a corresponding hole 8 formed in the vessel 1 and is secured to the latter by means of a flange 9 and screws 10. That portion will be termed "nozzle" hereinafter.

From the sleeve 7, there extends upwardly a tubular fitting 11 for connection to an inlet line 12 which, from a main duct 13, extends around the vessel 1. The main duct is connected to a low pressure steam source through a valve 14 controlled by or slaved to a pressure switch 15 which prevents the opening of the valve 14 when the steam pressure drops below a preset minimum value.

Inside the sleeve 7, a plunger 16 is slidable which has a sealing ring 17 made of a rubber material. The plunger is actuated by a pressure fluid actuator 18, which in the present embodiment comprises a cylinder wherein a piston is slidable, the rod whereof is connected to the plunger 16. The actuator 18 may be a manual or automatic one, and its actuation is controlled by that same pressure switch 15 which also controls the valve 14.

A temperature probe 19 permits the temperature of the mix inside the vessel 1 to be read, as well as control of an automatic steam metering apparatus, thereby the final temperature of the mix is at all times the preset one, regardless of the temperature of the individual components.

The apparatus described in the foregoing is then completed by the inclusion of a manually operated steam shut-off valve 20 located in the main duct 13.

The apparatus just described operates as follows.

After introducing the components in appropriate amounts into the vessel 1, the valve 20 is opened, thereby the pressure switch 15, if the steam has a sufficient pressure, controls the valve 14 to open and actuates the actuators 18, which open the ports of the fittings 11 to admit the steam into the vessel and heat the concrete mix. Upon the latter reaching the preset temperature, the probe 19 detects that temperature and reduces the amount of steam being metered until the pressure switch 15 is again actuated to cause the valve 14 and injectors 6 to be shut. The plungers 16 close the port of the nozzle of the sleeve 7 to the vessel, thus preventing the mix from flooding the fitting 11.

Preferably, the injected steam is at a low pressure (up to 1 atm.), thereby allowing the use of lower initial and operating cost generators than high pressure ones. Furthermore, the low pressure steam, having less kinetic energy, causes no air leakage and has a higher performance.

I claim:

1. An apparatus for mixing concrete, characterized in that it comprises a concrete mixing vessel, a plurality of injectors communicating with the vessel inside and arranged at the bottom thereof, means for connecting said injectors to a steam source, valve means controlling the opening and closing of said injectors, and actuating means controlling the opening and closing of said valve means.

2. An apparatus according to claim 1, characterized in that said actuating means are controlled by or slaved to a steam pressure responsive pressure switch.

3. An apparatus according to claim 2, characterized in that said means for connecting said injectors to said steam source comprise a line branching off a main duct wherein is located a valve controlled by or slaved to said pressure switch.

4. An apparatus according to claim 1, characterized in that the steam supply is controlled by a temperature probe adapted for detecting the temperature of the concrete during the mixing thereof.

5. An apparatus according to claim 1, characterized in that each injector comprises a sleeve communicating with the mixing vessel, wherethrough a hydraulically or pneumatically controlled plunger is slidable between opening and closing positions of the steam supply.

6. An apparatus according to claim 1, characterized in that said steam supply is a low pressure one (up to 1 atm.).

* * * * *